United States Patent [19]

Adams et al.

[11] 4,109,812

[45] Aug. 29, 1978

[54] DUMP CONTROL FOR LOADERS

[75] Inventors: Stanley B. Adams, Yorkville; Michael P. Morge, Oswego, both of Ill.

[73] Assignee: Caterpillar Tractor Co., Peoria, Ill.

[21] Appl. No.: 781,265

[22] Filed: Mar. 25, 1977

[51] Int. Cl.[2] ..... E02F 3/84

[52] U.S. Cl. ..... 214/762; 37/DIG. 1

[58] Field of Search ..... 214/764, 762, 142; 212/35 HC; 37/DIG. 1

[56] References Cited

U.S. PATENT DOCUMENTS

| | | | |
|---|---|---|---|
| 3,494,495 | 2/1970 | Alderman et al. | 214/762 |
| 3,522,897 | 8/1970 | Freedy | 214/764 |
| 3,836,032 | 9/1974 | Geier | 214/764 |
| 3,929,245 | 12/1975 | Inoue | 214/764 |
| 4,011,959 | 3/1977 | Papasideris | 214/762 |

*Primary Examiner*—Albert J. Makay
*Assistant Examiner*—Ross Weaver
*Attorney, Agent, or Firm*—Wegner, Stellman, McCord, Wiles & Wood

[57] ABSTRACT

A loader having a vehicle frame, a load lifter, a pair of arms each having one end pivoted to the frame and the other ends pivoted to the load lifter, at least one tilt cylinder carried by the arms and having an extendable rod, first links pivoted intermediate their ends to respective arms and at their ends to the rods and to second links. The second links are pivoted to the load lifter and there is included a hydraulic system including a manual actuator for controlling the cylinder to pivot the load lifter between forward and rearward positions on the arms. The invention contemplates a hydraulic element for sensing the position of the load lifter and for halting the flow of hydraulic fluid to and from the cylinder when the load lifter is moving forwardly on the arms just short of the forward position to halt such movement and provide a hydraulic cushioning effect.

4 Claims, 3 Drawing Figures

20
22
24
26
28
30
34
36
38
40
42
44
46
48
50
52

DUMP CONTROL FOR LOADERS

BACKGROUND OF THE INVENTION

This invention relates to loaders and, more specifically, to improved controls for dumping devices on loaders.

Loaders of varying sort art being manufactured in ever-increasing size to provide increased loading capacity. With the increased load capacity, there is, however, an increased problem of stressing of linkages and cylinders, particularly when the load on a load lifter, such as a fork or a bucket, is being dumped. The stresses are acute when mechanical stops are utilized to position the load lifter in its dump position.

SUMMARY OF THE INVENTION

The present invention is directed to overcoming one or more of the problems as set forth above.

According to the present invention, the loader has a vehicle frame, a load lifter, a pair of arms, each having one end pivoted to the frame and the other end pivoted to the load lifter, and at least one cylinder carried by the arms and having an extendable rod. A first link is pivoted intermediate its ends to an arm and at its ends to the rod and to a second link. The second link is pivoted to the load lifter and a hydraulic system, including a manual actuator, it utilized for controlling the cylinder to pivot the load lifter between forward and rearward positions on the arms, the forward position corresponding to a dump position. The improved vehicle includes a means for sensing the position of the load lifter and for halting the flow of hydraulic fluid to and from the cylinder when the load lifter is moving forwardly on the arms just short of the forward position to thereby stop movement of the load lifter and hydraulically cushion the same without the load lifter bottoming out against mechanical stops.

Other objects and advantages will become apparent from the following specification taken in connection with the accompanying drawings.

DESCRIPTION OF THE PREFERRED EMBODIMENT

Figure 1:
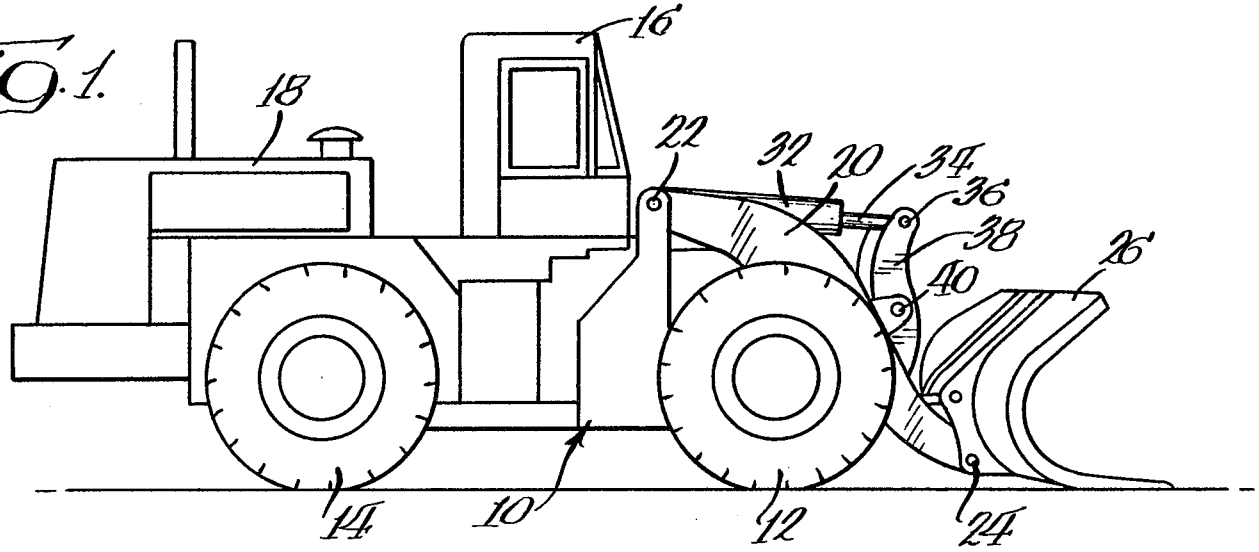
FIG. 1 is a side elevation of a loader made according to the invention.

An exemplary embodiment of a loader made according to the invention is illustrated in FIG. 1 and is seen to include a vehicle frame, generally designated 10, having forward and rear wheels 12 and 14, respectively. The frame 10 mounts a cab 16 which may be occupied by an operator of the vehicle in a conventional fashion as well as an engine 18 which drive the vehicle over the underlying terrain and drives a hydraulic pump or the like for providing hydraulic fluid under pressure to cylinders for performing various functions to be described hereinafter.

At the forward end of the frame 10, a pair of lift arms 20 are pivoted as at 22 to the frame and as at 24 to a load lifter 26 which, according to the present invention, is a lifting fork, but could be a bucket or the like.

Figure 2:
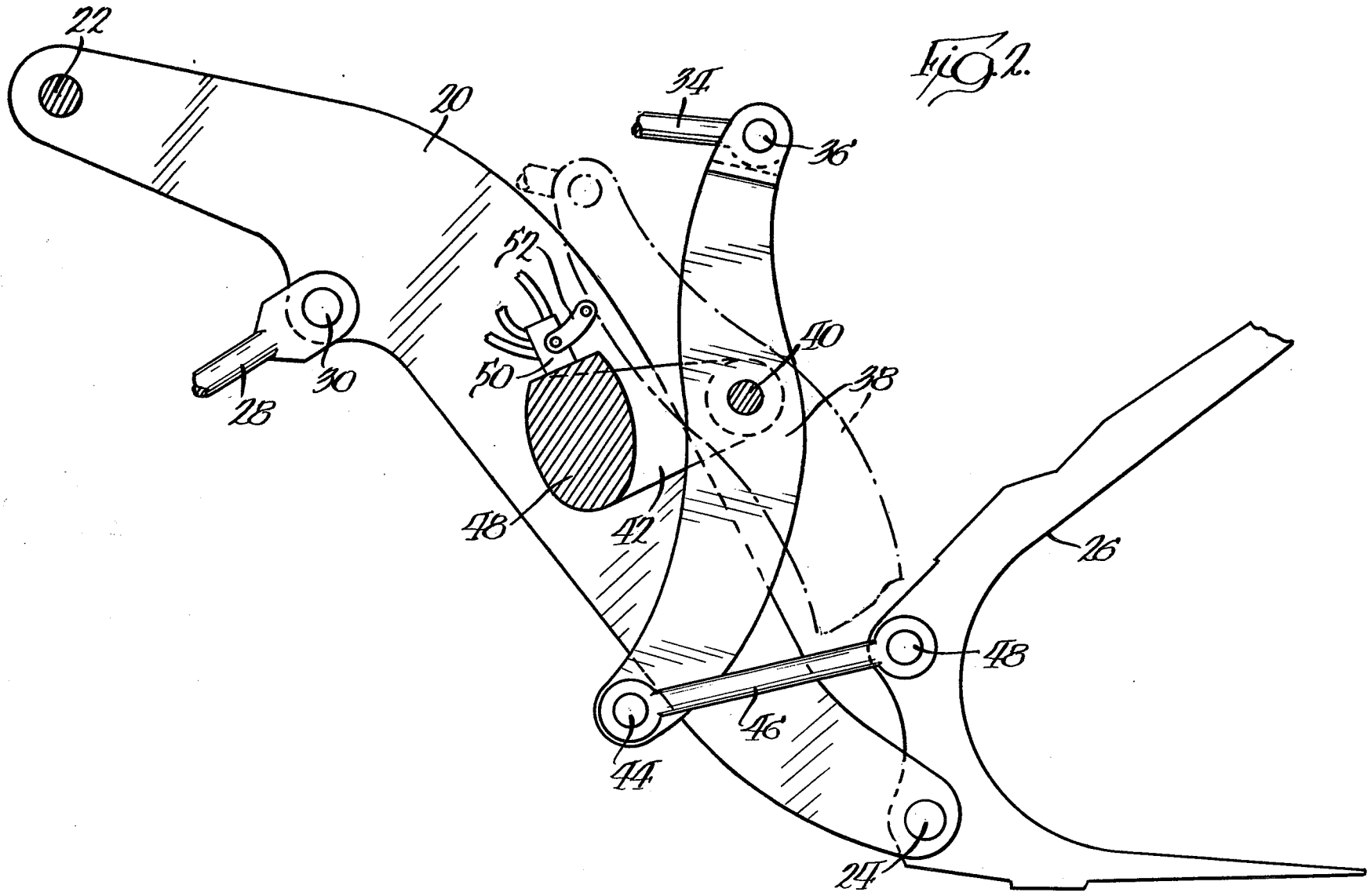
FIG. 2 is an enlarged, fragmentary view of a portion of the lift mechanism of the loader with parts shown in section.

As seen in FIG. 2, the rod 28 of a hydraulic cylinder (not shown) is pivotally connected at 30 to the lift arm 20 intermediate its ends. Those skilled in the art will recognize that operation of the hydraulic cylinder associated with the rod 28 will cause elevation or dropping of the arms 20 about the pivot 22. In general, there will be a cylinder and associated rod 28 for each of the lift arms 20.

Returning to FIG. 1, a pair of cylinders 32 (only one of which is shown) are pivotally connected to associated sides of the frame 10 adjacent the pivots 22. The cylinders 32 are double-acting and have rods 34 which are pivotally connected as at 36 to the upper ends of links 38 associated with corresponding ones of the lift arms 20. The links 38 are pivoted at 40 intermediate their ends to forwardly projecting ears 42 mounted on corresponding ones of the lift arms 20. The ends of the links 38 opposite from the pivots 36 are pivotally connected as at 44 to second links 46 which, in turn, are pivotally connected as at 48 to the load lifter 26 at a location above the pivots 24.

A cross member 48 extends between the lift arms 20 to rigidify the overall structure and similar cross arms may interconnect the links 38. Mounted on the upper surface of the cross member 48 is a valve 50 having an actuator 52 which is positioned to be engaged by the rear side of one of the links 38 when the same approaches an extreme position of counterclockwise rotation about the pivot 40 which corresponds to a forward movement of the load lifter 26 about the pivot 24 towards its forwardmost position. It is to be specifically noted that the actuator 52 trips the valve 50 just prior to the load lifter 26 attaining its forwardmost position as permitted by the various mechanical structure involved.

The valve 50 is of the type having three ports, one of which may be connected to drain in a hydraulic system to be described in greater detail hereinafter. One port is a supply port and when the valve 50 does not have its actuator 52 tripped, fluid introduced into the supply port will flow to an outlet port to be transmitted elsewhere in the system. When the actuator 52 is tripped, pressure at the outlet port is directed to the drain port and the supply port is cut off.

Figure 3:
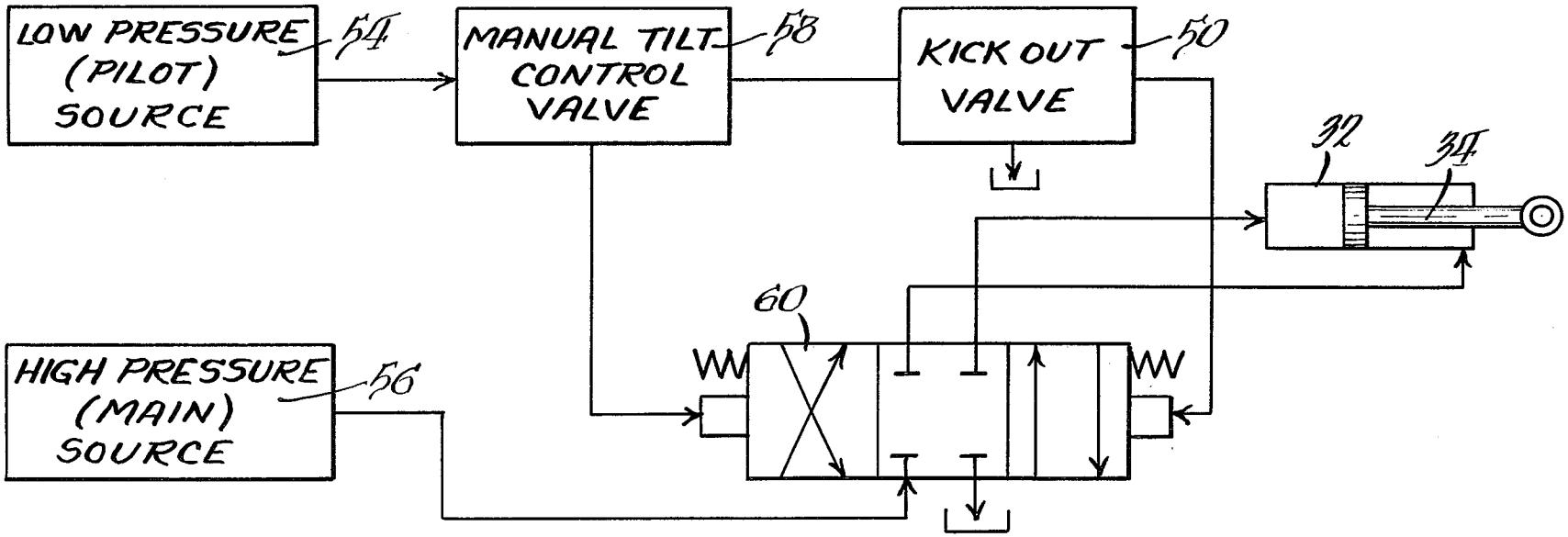
FIG. 3 is a schematic of a hydraulic system employed in the loader.

Turning now to FIG. 3, a hydraulic control circuit employing the valve 50 is illustrated. The circuit includes a low pressure source 54 of hydraulic fluid, which low pressure fluid is utilized as a pilot actuator as will be seen. The system also includes a high pressure fluid source 56 which provides fluid under pressure for operating the cylinder 32 as well as the cylinders (not shown) associated with the rods 28.

Within the cab 16 there is located a manual tilt control valve 58 which may be of conventional construction and the system is completed by a double piloted, self-centering, closed center, four-way valve 60.

The low pressure source 54 provides pilot fluid to the control valve 58 which is utilized for shifting the spool of the valve 60. For one position of the control valve, the spool may be shifted to the right, as viewed in FIG. 3, to cause extension of the cylinder rod 34 to move the load lifter 26 to its rearward position on the arms. Alternately, the control valve may be operated to direct pilot fluid through the valve 50 to the valve 60 to shift the spool to the left, as viewed in FIG. 3, to cause retraction of the rod 34 of the cylinder 32 and move the load lifter 26 towards its forwardmost position on the arms 20. Finally, the control valve may be operated so as to preclude the flow of fluid to either of the pilots associated with the valve 60 whereupon the self-centering action of the same will cause the spool to assume the position illustrated in FIG. 3 in which fluid flow, both to and from the cylinder 32, will be blocked.

Throughout the vast majority of the operating cycle of the mechanism, the valve 50 will be open to direct pilot fluid to the valve 60 to shift the spool to the left, assuming that the valve 58 is directing pilot fluid to the valve 50. However, when the forwardmost position of the load lifter 26 is approached, the links 38 will engage the actuator 52 of the valve 50 to cut off the supply and connect the associated pilot of the valve 60 to reservoir to relieve leftward urging pilot pressure in the valve 60. Since, at this time, the valve 58 will not be directing pilot fluid to the valve 60 such as would urge the spool to the right, the self-centering action of the valve 60 will cause the same to center thereby trapping fluid on both sides of the piston within the cylinder 32 prior to mechanical abutment of structure associated with the load lifter 26 when in its forwardmost position. As a consequence, the trapped columns of fluid act as a hydraulic cushion halting further forward movement of the load lifter 26 and thereby prevent the generation of high stresses associated with mechanical stops which could result in fatigue to the links and/or buckling of the cylinders, including the rods 34.

It will be appreciated by those skilled in the art that the present system inexpensively and economically provides a means for not only preventing undesirable mechanical contact of the load lifter 26 against mechanical stops, but additionally provides hydraulic cushioning of the same when the forwardmost position is approached to prevent damage to mechanical components.

The embodiments of the invention in which an exclusive property or privilege is claimed are defined as follows:

1. A vehicle having a frame, a load lifter, a pair of arms each having one end pivoted to the frame and the other end pivoted to the load lifter, at least one tilt cylinder carried by the arms and having an extendable rod, a first link pivoted intermediate its ends to an arm and at its ends to said rod and to a second link, said second link being pivoted to said load lifter, a hydraulic system including a manual actuator for controlling the cylinder to pivot the load lifter between forward and rearward positions on the arms, means for sensing the position of said load lifter and for halting the flow of hydraulic fluid to and from said cylinder when said load lifter is moving forwardly on said arms just short of said forward position to trap hydraulic fluid within said cylinder to act as a hydraulic cushion halting further forward movement of said load lifter, and a cross member extending between said arms, said sensing means comprises a sensing valve mounted on said cross member and having an actuator positioned to be engaged by said first link.

2. The loader of claim 1 wherein said hydraulic system includes a four-way, self-centering, double piloted valve connected to said cylinder, and wherein said sensing valve is operable to block the flow of pilot fluid to one of the pilots of said four-way valve, whereby said four-way valve will center to halt the flow of hydraulic fluid to and from said cylinder to hydraulically cushion said forward movement of said load lifter.

3. The vehicle of claim 1 wherein said cylinder is double acting and wherein said hydraulic system includes means for providing hydraulic fluid under high and low pressures; a double piloted, self-centering, four-way valve connected to said cylinder for directing high pressure fluid to either side thereof and for preventing the flow of fluid to or from said cylinder, a manual control valve for directing low pressure fluid to one pilot of said four-way valve to cause the four-way valve to direct high pressure fluid to one side of the cylinder to cause the load lifter to move rearwardly on said arms and for directing low pressure fluid to the other pilot of said four-way valve to cause said four-way valve to direct high pressure fluid to the other side of said cylinder to cause the load lifter to move forwardly on said arms, said sensing valve being operatively interposed between said manual control valve and said other pilot.

4. The vehicle of claim 1 wherein said sensing valve is mounted on the upper surface of said cross member and said actuator is positioned to be engaged by said first link at a position intermediate the ends of said first link.

* * * * *